US009238959B2

(12) United States Patent
McElhinney et al.

(10) Patent No.: US 9,238,959 B2
(45) **Date of Patent: *Jan. 19, 2016**

(54) METHODS FOR IMPROVED ACTIVE RANGING AND TARGET WELL MAGNETIZATION

(75) Inventors: Graham A. McElhinney, Aberdeenshire (GB); Robert A. Moore, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 421 days.

This patent is subject to a terminal disclaimer.

(21) Appl. No.: 12/962,058

(22) Filed: Dec. 7, 2010

(65) Prior Publication Data

US 2012/0139543 A1 Jun. 7, 2012

(51) Int. Cl.

| | |
|---|---|
| ***G01V 3/00*** | (2006.01) |
| ***E21B 47/02*** | (2006.01) |
| ***E21B 47/022*** | (2012.01) |
| ***E21B 7/04*** | (2006.01) |

(52) U.S. Cl.

CPC ..... *E21B 47/02216* (2013.01); *E21B 7/046* (2013.01)

(58) Field of Classification Search

CPC ..... E21B 47/02216
USPC ..... 324/346; 175/45
See application file for complete search history.

(56) References Cited

U.S. PATENT DOCUMENTS

| | | | | |
|---|---|---|---|---|
| 2,596,322 A | | 5/1952 | Zumwalt | |
| 2,980,850 A | | 4/1961 | Cochran | |
| 3,117,065 A | | 1/1964 | Wootten | |
| 3,673,629 A | | 7/1972 | Casey et al. | |
| 3,725,777 A | | 4/1973 | Robinson et al. | |
| 3,727,126 A | * | 4/1973 | Kiselman et al. | 324/221 |
| 3,862,499 A | | 1/1975 | Isham et al. | |
| 4,072,200 A | | 2/1978 | Morris et al. | |
| 4,458,767 A | | 7/1984 | Hoehn, Jr. | |

(Continued)

FOREIGN PATENT DOCUMENTS

| | | |
|---|---|---|
| CA | 2490953 | 6/2006 |
| CN | 101099024 A | 1/2008 |

(Continued)

OTHER PUBLICATIONS

A.G. Nekut, et al., "Rotating magnet Ranging—A new drilling guidance technology," 8th One Day Conference on Horizontal Well Technology, Canadian Sections SPE/Petroleum Society, Nov. 7, 2001.

(Continued)

*Primary Examiner* — Jay Patidar
*Assistant Examiner* — David M. Schindler
(74) *Attorney, Agent, or Firm* — Kimberly Ballew

(57) ABSTRACT

A method for magnetizing a portion of a pre-deployed casing string includes deploying an electromagnetic array in a cased wellbore and energizing the array. The array includes a plurality of axially spaced electromagnets and is configured to generate a magnetic field pattern having at least first and second pairs of magnetically opposing poles. Passive ranging measurements of the induced magnetic field may be advantageously utilized, for example, to survey and guide continued drilling of a twin well. The electromagnetic array may also be used in active ranging applications. An array of permanent magnets providing a similar magnetic field pattern may also be used in active ranging applications.

11 Claims, 7 Drawing Sheets

(56) References Cited

U.S. PATENT DOCUMENTS

| | | | | |
|---|---|---|---|---|
| 4,465,140 | A | 8/1984 | Hoehn, Jr. | |
| 4,672,345 | A | 6/1987 | Littwin | |
| 4,713,960 | A * | 12/1987 | Gassaway | 72/412 |
| 4,716,960 | A | 1/1988 | Eastlund et al. | |
| 4,730,230 | A | 3/1988 | Helfrick | |
| 4,743,849 | A | 5/1988 | Novikov | |
| 4,931,760 | A | 6/1990 | Yamaguchi | |
| 5,025,240 | A | 6/1991 | La Croix | |
| 5,126,720 | A | 6/1992 | Zhou et al. | |
| 5,148,869 | A | 9/1992 | Sanchez | |
| 5,230,387 | A | 7/1993 | Waters et al. | |
| 5,319,335 | A | 6/1994 | Huang et al. | |
| 5,351,004 | A | 9/1994 | Daniels et al. | |
| 5,428,332 | A | 6/1995 | Srail et al. | |
| 5,485,089 | A | 1/1996 | Kuckes | |
| 5,512,830 | A | 4/1996 | Kuckes | |
| 5,541,517 | A | 7/1996 | Hartmann et al. | |
| 5,589,775 | A | 12/1996 | Kuckes | |
| 5,657,826 | A | 8/1997 | Kuckes | |
| 5,659,280 | A | 8/1997 | Lee et al. | |
| 5,675,488 | A | 10/1997 | McElhinney | |
| 5,725,059 | A | 3/1998 | Kuckes et al. | |
| 5,923,170 | A | 7/1999 | Kuckes | |
| 6,060,970 | A | 5/2000 | Bell | |
| 6,310,532 | B1 | 10/2001 | Santa Cruz et al. | |
| 6,369,679 | B1 | 4/2002 | Cloutier et al. | |
| 6,466,020 | B2 | 10/2002 | Kuckes et al. | |
| 6,670,806 | B2 | 12/2003 | Wendt et al. | |
| 6,698,516 | B2 | 3/2004 | Van Steenwyk et al. | |
| 6,736,222 | B2 | 5/2004 | Kuckes et al. | |
| 6,937,023 | B2 | 8/2005 | McElhinney | |
| 6,985,814 | B2 | 1/2006 | McElhinney | |
| 6,991,045 | B2 | 1/2006 | Vinegar et al. | |
| 7,510,030 | B2 | 3/2009 | Kuckes et al. | |
| 7,538,650 | B2 | 5/2009 | Stenerson et al. | |
| 7,568,532 | B2 | 8/2009 | Kuckes et al. | |
| 7,617,049 | B2 | 11/2009 | McElhinney et al. | |
| 7,656,161 | B2 | 2/2010 | McElhinney | |
| 7,712,519 | B2 | 5/2010 | McElhinney et al. | |
| 7,716,960 | B2 | 5/2010 | Tamezane et al. | |
| 2003/0173072 | A1 * | 9/2003 | Vinegar et al. | 166/66.5 |
| 2003/0188891 | A1 | 10/2003 | Kuckes | |
| 2004/0051610 | A1 | 3/2004 | Sajan | |
| 2004/0119607 | A1 | 6/2004 | Davies et al. | |
| 2004/0263300 | A1 | 12/2004 | Maurer et al. | |
| 2006/0131013 | A1 | 6/2006 | McElhinney | |
| 2008/0041626 | A1 * | 2/2008 | Clark | 175/45 |
| 2008/0177475 | A1 | 7/2008 | McElhinney et al. | |
| 2009/0030615 | A1 | 1/2009 | Clark | |
| 2009/0194333 | A1 * | 8/2009 | MacDonald | 175/45 |
| 2009/0201026 | A1 | 8/2009 | McElhinney | |
| 2009/0308072 | A1 | 12/2009 | Kay et al. | |
| 2009/0308657 | A1 * | 12/2009 | Clark et al. | 175/45 |
| 2010/0155139 | A1 | 6/2010 | Kuckes | |
| 2012/0138291 | A1 * | 6/2012 | Tomberlin et al. | 166/254.2 |
| 2012/0139530 | A1 * | 6/2012 | McElhinney et al. | 324/207.13 |

FOREIGN PATENT DOCUMENTS

| | | | |
|---|---|---|---|
| CN | 101120155 | A | 2/2008 |
| EP | 0301671 | B1 | 2/1989 |
| EP | 0682269 | B1 | 8/2001 |
| GB | 2376747 | B | 1/2005 |
| GB | 2398638 | B | 8/2006 |
| GB | 2402746 | B | 11/2006 |
| JP | 60086809 | A | 5/1985 |
| JP | 03094407 | A | 4/1991 |
| SU | 1377801 | A1 | 2/1988 |
| WO | 95/19490 | | 7/1995 |

OTHER PUBLICATIONS

J.I. De Lange and T.J. Darling, "Improved detectability of blowing wells," SPE Drilling Engineering, Mar. 1990.

W-D Coils brochure by Western Instruments, published Mar. 2001: http://www.westerninstruments.com/portableMPI/coils/WD_COI_1.jpg, http://www.westerninstruments.com/portableMPI/coils/WD_COI_2.gif; and http://www.westerninstruments.com/portableMPI/coils/WD_COI_3.gif.

T.L. Grills, "Magnetic ranging technologies for drilling steam assisted gravity drainage well pairs and unique well geometries—A comparison of Technologies," SPE/Petroleum Society of CIM/CHOA 79005, 2002.

McElhinney, Graham, et al.; "Case histories demonstrate a new method for well avoidance and relief well drilling," SPE/IADC Drilling Conference Amsterdam, Mar. 4-6, 1997, SPE/IADC 37667.

International Search Report and Written Opinion for PCT/US2011/063285 on Jul. 31, 2012, pp. 1-9.

Examination Report issued in CA2820224 on Feb. 3, 2015, 6 pages.

Office Action issued in CN201180061518.0 on Mar. 27, 2015, 20 pages.

Decision on Grant issued in RU2013131035 on Feb. 9, 2015, 12 pages.

Office Action issued in RU2013131035 on Jul. 3, 2014, 31 pages.

* cited by examiner

METHODS FOR IMPROVED ACTIVE RANGING AND TARGET WELL MAGNETIZATION

RELATED APPLICATIONS

None.

FIELD OF THE INVENTION

The present invention relates generally to drilling and surveying subterranean boreholes such as for use in oil and natural gas exploration. In particular, this invention relates to an apparatus and method for imparting a predetermined magnetic pattern to an installed casing string as well as to an apparatus and method for active ranging.

BACKGROUND OF THE INVENTION

Active magnetic ranging techniques are commonly utilized in well twinning and well intercept applications, for example, including steam assisted gravity drainage (SAGD) and coal-bed methane (CBM) drilling applications. In one known active ranging method (e.g., as disclosed in U.S. Pat. No. 5,485,089), a high strength electromagnet is pulled down through a cased target well during drilling of a twin well. An MWD tool deployed in the drill string measures the magnitude and direction of the magnetic field during drilling of the twin well to determine a distance and direction to the target. In another known active ranging method (e.g., as disclosed in U.S. Pat. No. 5,589,775), a magnet is mounted on a rotating sub below a drilling motor (deployed in the twin well). A wireline tool is pulled down through the cased target well and measures the magnitude and direction of the magnetic field during drilling of the twin well. Both methods utilize the magnetic field measurements to compute a range and bearing (a distance and a direction) from the twin well to the target well and to guide continued drilling of the twin.

The prior art active ranging methods described above, while utilized in commercial SAGD operations, are known to include several significant drawbacks. For example, both techniques require precise lateral (z-directional) alignment between the magnetic source deployed in one well and the magnetic sensors deployed in the other. Misalignment can result in a misplaced twin well, which can have a significant negative impact on future well productivity. Moreover, the steps taken to assure proper alignment (such as making magnetic field measurements at multiple longitudinal positions in one of the wells) are time consuming (and therefore expensive) and may further be problematic in deep wells. Still further, the approach described in the '089 patent requires surveying measurements to be made at both positive and negative electromagnetic source polarities in order to cancel out remanent magnetization in the target casing. As a result, surveying time (and therefore the time required to drill the twin well) becomes even more excessive.

U.S. Pat. Nos. 6,985,814; 7,538,650; 7,617,049; 7,656,161; and 7,712,519 disclose enhanced passive ranging techniques suitable for well twinning and well intercept applications. These techniques often impart certain advantages over the above described active ranging techniques. However, magnetizing large numbers of casing tubulars, storing the magnetized tubulars, and deploying the magnetized tubulars in the target well tends to introduce technical and logistical challenges. While these challenges have been adequately overcome for commercial deployment of the technology, there is a need for an improved method of magnetizing the target well, particularly a method that reduces handling requirements of the magnetized tubulars.

SUMMARY OF THE INVENTION

Exemplary aspects of the present invention are intended to address the above described drawbacks of prior art ranging and twin well drilling methods. One aspect of this invention includes a method for magnetizing a portion of a casing string deployed in a wellbore. An electromagnetic array is deployed in the cased wellbore and energized. The array includes a plurality of axially spaced electromagnets and is configured to generate a magnetic field pattern having at least first and second pairs of magnetically opposing poles. Passive ranging measurements of the induced magnetic field may be advantageously utilized, for example, to survey and guide continued drilling of a twin well. The electromagnetic array may also be used in active ranging applications. An array of permanent magnets providing a similar magnetic field pattern may also be used in active ranging applications.

Exemplary embodiments of the present invention provide several potential advantages. For example, the invention enables a previously deployed casing string to be magnetized in-situ. The strong, highly uniform magnetic field about the string tends to be advantageous for subsequent passive ranging measurements made, for example, during twin well operations.

Aspects of the invention are further advantageous in active ranging operations. For example, the use of an electromagnetic array having a plurality of pairs of magnetically opposing poles provides a strong, uniform magnetic field about a selected portion of the wellbore. Due to the uniformity of the magnetic field strength, there is no need to precisely laterally align the magnetic source in the target well and the measurement sensors in the drilling well. This tends to simplify the ranging operation, thereby saving time and improving accuracy.

Electromagnet and permanent magnet arrays in accordance with the present invention tend to focus magnetic flux through the casing string. This results in a stronger, more uniform magnetic field about the casing string and thereby improves ranging accuracy. Moreover, the induced external magnetic field tends to less sensitive to the thickness of the wellbore tubulars used to case the well.

In one aspect the present invention includes a method for magnetizing a portion of a casing string in a subterranean borehole in which the casing string has been previously deployed in the borehole. An electromagnetic array is deployed in the casing string. The electromagnetic array includes a plurality of axially spaced apart electromagnets deployed co-axially in a non-magnetic housing. The plurality of electromagnets are connected to an electrical power source such that a first subset of the electromagnets generates magnetic flux in a first axial direction and a second subset of the coils generates magnetic flux in a second opposing axial direction so as to impart a predetermined magnetic field pattern to the casing string. The magnetic field pattern has at least first and second pairs of magnetically opposing poles. The electromagnets are then disconnected from the power source.

In another aspect, the present invention includes a method for surveying a borehole with respect to a target well. An electromagnetic array is deployed in the target well. The electromagnetic array includes a plurality of axially spaced apart electromagnets deployed co-axially in a non-magnetic housing. The electromagnets are connected to an electrical power source such that a first subset of the electromagnets generates magnetic flux in a first axial direction and a second subset of the electromagnets generates magnetic flux in a second opposing axial direction so as to produce a magnetic field pattern having at least first and second pairs of magnetically opposing poles. A downhole tool a having a magnetic field measurement device is positioned in the borehole within sensory range of the magnetic field generated by the electromagnetic array. A local magnetic field is measured in the borehole using the magnetic field measurement device. The measured magnetic field is then processed to determine at least one of (i) a distance and (ii) a direction from the borehole to the target well. In alternative embodiments, an array of permanent magnets may be utilized in place of the electromagnetic array.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
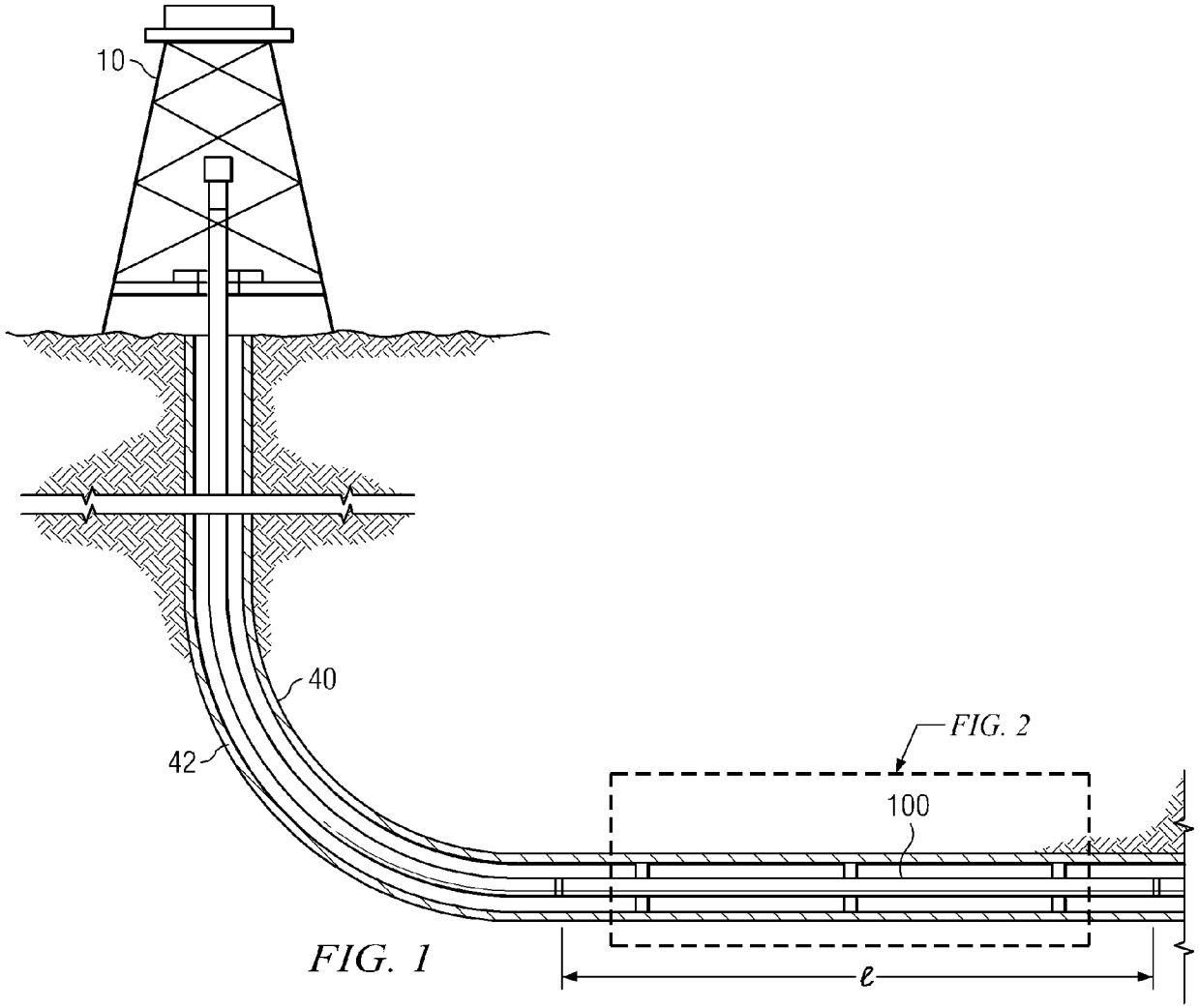
FIG. 1 depicts one example of an electromagnetic array deployed in a subterranean borehole.

Referring now to FIGS. 1 through 12, exemplary embodiments of the present invention are depicted. With respect to FIGS. 1 through 12, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 12 may be described herein with respect to that reference numeral shown on other views.

FIG. 1 depicts one exemplary embodiment of an operation for magnetizing a wellbore casing in accordance with the present invention. In FIG. 1, a rig 10 is positioned over a subterranean oil or gas formation (e.g., a tar sands formation—not shown). The rig may include, for example, a derrick and a hoisting apparatus for lowering and raising various components into and out of the wellbore 40. In the exemplary embodiment depicted, wellbore 40 is cased (lined) using conventional cemented steel tubulars 42. An electromagnetic array 100 is deployed in the wellbore 40. The array 100 may be pushed down into the wellbore, for example, using conventional drill pipe or coiled tubing as depicted on FIG. 1 or pulled down into the wellbore, for example, using a conventional tractor arrangement. The invention is not limited in these regards.

Figure 2:
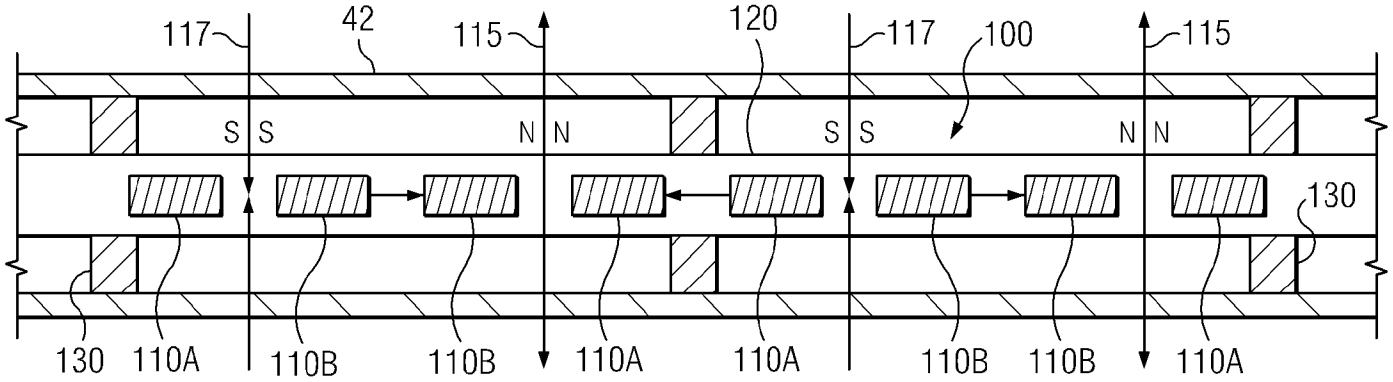
FIG. 2 depicts the electromagnetic array shown on FIG. 1.

Turning now to FIG. 2, electromagnetic array 100 includes a plurality of electromagnets 110A and 110B. The electromagnets are wound such that energizing the array (applying an electrical current to the electromagnets) produces a plurality of pairs of magnetically opposing NN and SS magnetic poles along the length of the array (as depicted). Such magnetically opposing poles effectively focus magnetic flux outward from or inward towards the array 100 as shown at 115 and 117. In the exemplary embodiment depicted on FIG. 2, array 100 includes eight individual electromagnets (four of 110A and four of 110B) configured to induce four pairs of magnetically opposing poles (two NN poles and two SS poles). It will be understood that the invention is not limited to an electromagnetic array including any particular number electromagnets.

A suitable electromagnetic array 100 includes a plurality of electromagnets 110A and 110B deploy in a non magnetic housing 120. The housing 120 preferably includes (or is fitted with) one or more centralizers 130 (e.g., stabilizer fins) configured to substantially center the housing 120 in the casing string. The invention is not limited to any particular centralizing configuration. The electromagnets 110A and 110B may be advantageously axially spaced apart from one another and deployed substantially coaxially with one another in the housing 120 (e.g., as depicted).

Substantially any suitable electromagnets may be utilized. High strength electromagnets are preferred and generally include a coil having a large number of turns of an insulated electrical conductor wound about a ferromagnetic core. Preferred high strength electromagnets are generally configured to be capable of generating a large magnetic flux (e.g., on the order of 1 Weber or greater). In one exemplary embodiment each of the electromagnets includes a substantially cylindrical soft iron core having a length of several feet (e.g., 4, 8, or 16 feet). The core is preferably wound with several thousand wraps of electrical conductor (e.g., 4000, 8000, or 16,000 wraps). The conductor is preferably of a sufficient diameter to enable the use of large electrical currents (e.g., 1 Amp or greater) without a significant temperature increase.

Advantageous electromagnetic array embodiments typically include at least eight electromagnets and are configured to induce at least three pairs of magnetically opposing poles, although the invention is not limited in this regard. In general, embodiments having a large number of regularly spaced electromagnets (e.g., 8 or more) tend to be advantageous in that they enable a strong, periodic magnetic pattern to be imparted to the casing string. This in turn tends to provide a stronger, more uniform magnetic field about the casing string and thus enables more accurate and reliable passive ranging. It will of course be appreciated that the advantages inherent in increasing the number of electromagnets should be balanced by the increased cost and power consumption of such embodiments.

With continued reference to FIG. 2, one or more pairs of magnetically opposing poles may be imparted, for example, by polarizing adjacent electromagnets 110A and 110B in opposite directions. In the exemplary embodiment depicted, electromagnets 110A may be polarized such that an electrical current is induced in a clockwise direction about a magnetically permeable core, which in turn induces a magnetic field having north N and south S poles as shown. Electromagnets 110B are polarized in the opposite direction such that the electrical current is induced in a counterclockwise direction about the magnetically permeable core, which in turn induces an opposing magnetic field having north N and south S poles in the opposite direction as shown. Opposing pairs of north-north NN and south-south SS poles are thereby induced as shown schematically at 115 and 117.

It will be understood that electromagnets 110A and 110B are substantially identical but are configured such that electrical current flows in opposite directions (clockwise vs. counterclockwise) about the core. It will also be understood that the electromagnets 110A and 110B are typically energized from the surface (since the electromagnets typically require several watts of electrical power), for example, via an electrical connection that runs upward through housing 120 (and possibly through a length of coiled tubing) to the surface. It will be further understood that the electromagnet polarity may be set either at the surface or in the array. The invention is not limited to any particular wiring arrangement or any particular means for controlling the polarity.

Figure 3:
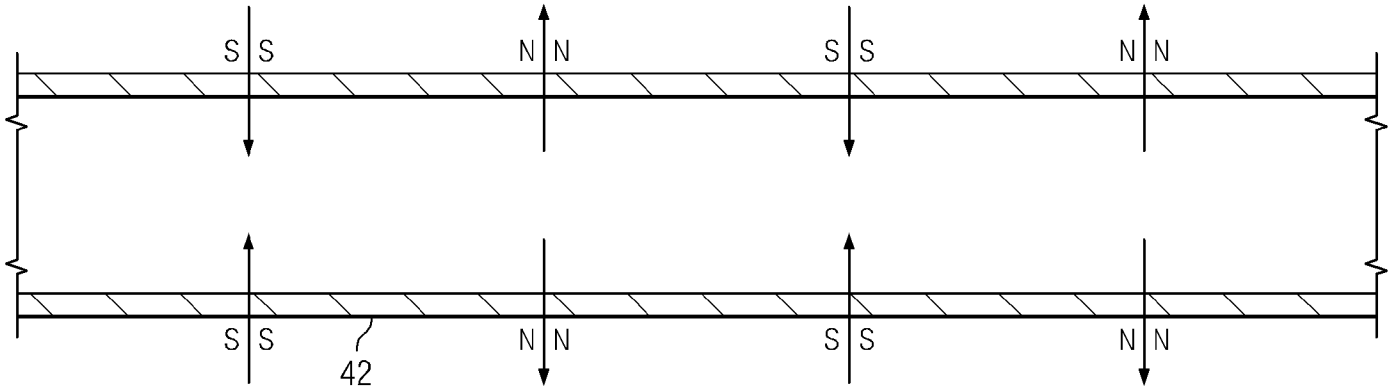
FIG. 3 depicts a length of magnetized casing string after removal of the electromagnetic array shown on FIG. 2.

Turning now to FIG. 3, energizing the electromagnetic array 100 (i.e., the electromagnets in the array) while it is deployed in a cased wellbore (as depicted on FIG. 2) causes a similar magnetic field pattern to be imparted to the casing string. FIG. 3 depicts the magnetized wellbore casing after removal of the array 100. In the exemplary embodiment depicted, two NN magnetically opposing poles and two SS magnetically opposing poles are imparted to casing string 42. The purpose of the pairs of opposing magnetic poles is to focus magnetic flux inward or outward from the casing string as shown.

Figure 4:
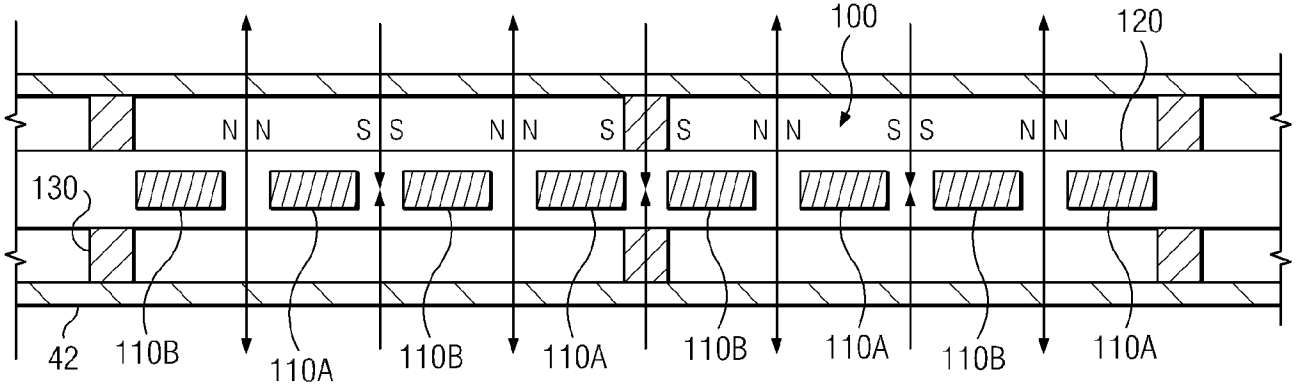
FIG. 4 depicts an alternative electromagnetic array.
Figure 11:
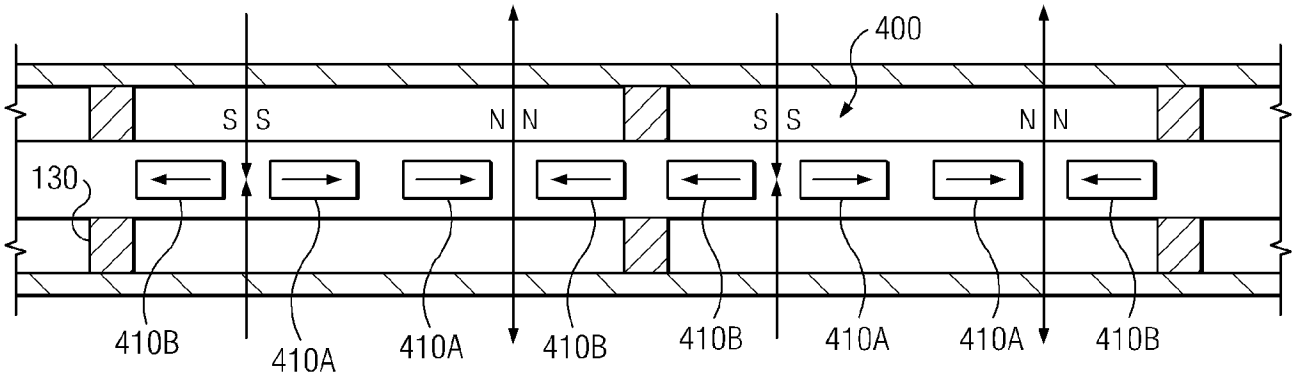
FIG. 11 depicts the array of permanent magnets shown on FIG. 10.

Referring now to FIGS. 2 and 4, the exemplary electromagnetic array 100 depicted advantageously enables up to seven pairs of magnetically opposing poles to be imparted (at any of the seven midpoints between adjacent pairs of electromagnets). FIG. 4 depicts the impartation of seven pairs of magnetically opposing poles. It will be understood that array embodiments including more electromagnets will be able to impart more pairs of opposing poles (if desired). For example, an array including 16 electromagnets is capable of imparting up to 15 pairs of opposing poles to the casing string (e.g., at any of the 15 midpoints between adjacent pairs of electromagnets).

It will be understood that the preferred spacing of pairs of magnetically opposing poles along a casing string depends on many factors, such as the desired distance between the twin and target wells in a well twinning operation, and that there are tradeoffs in utilizing any particular spacing. In general, the magnetic field strength about a casing string (or section thereof) becomes more uniform along the longitudinal axis of the casing string with reduced longitudinal spacing between the pairs of opposing poles. However, the fall off rate of the magnetic field strength as a function of radial distance from the casing string tends to increase as the axial spacing between pairs of opposing poles decreases. Thus, it may be advantageous to use an electromagnetic array configured to impart more closely spaced pairs of opposing poles for applications in which the desired distance between twin and target wells is relatively small and to use an electromagnetic array configured to impart pairs of opposing poles having a greater spacing for applications in which the desired distance between twin and target wells is larger.

Figure 5:
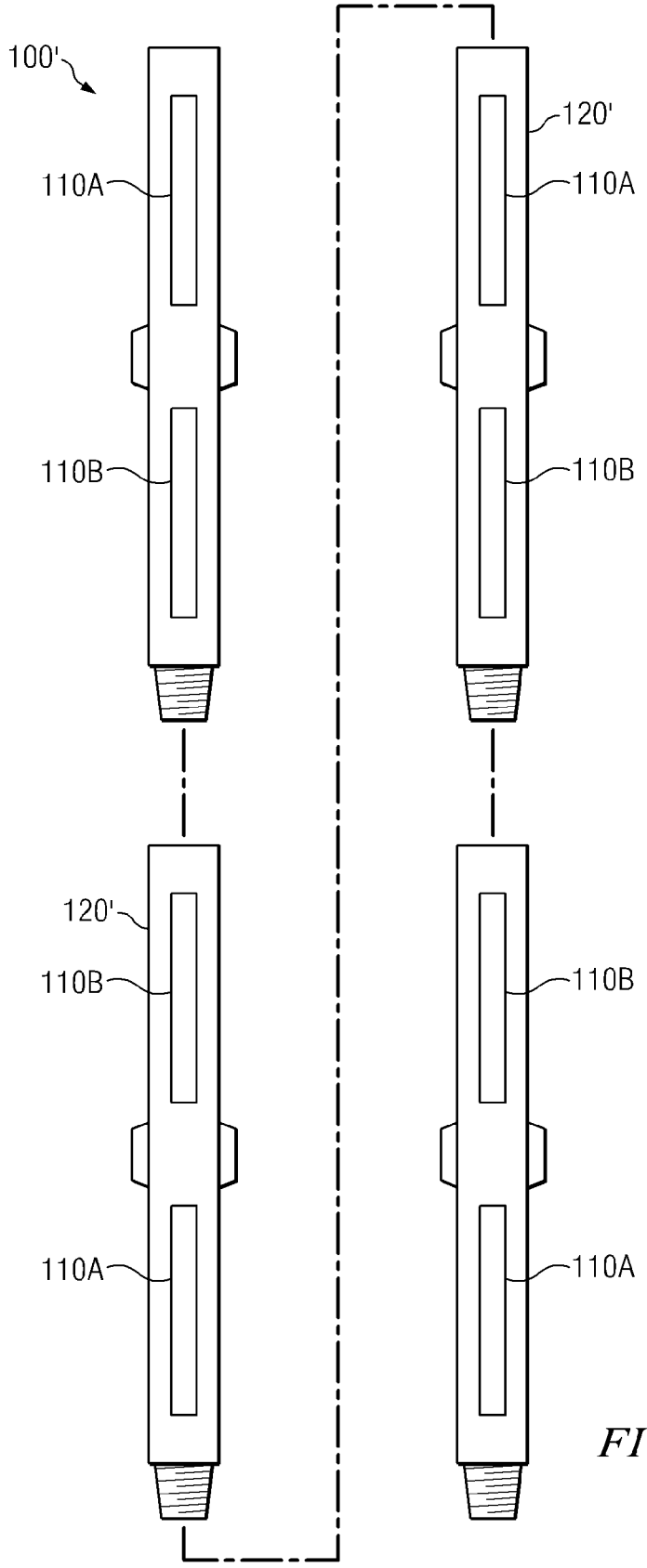
FIG. 5 depicts another alternative electromagnetic array.

In certain SAGD well twinning operations an axial spacing of about 40 feet (about 13 meters) has been found to be advantageous. In such applications, it may not be desirable (or even feasible) to use a single-piece electromagnetic array due to the excessive length required. For such applications a multiple piece array may be preferable. FIG. 5 depicts one exemplary embodiment of a multiple piece (section) electromagnetic array 100'. In the exemplary embodiment depicted, the non magnetic housing 120' includes four cylindrical sections configured to be threaded end to end. Each section includes first and second electromagnets 110A and 110B. Those of ordinary skill in the art will readily appreciate that the exemplary embodiment depicted on FIG. 5 is magnetically similar to that depicted on FIG. 2 in that it includes eight electromagnets configured to generate four pairs of magnetically opposing poles (two NN and two SS). It will be understood that the invention is not limited to an electromagnetic array including any particular number of sections.

With reference again to FIG. 1, electromagnetic array 100 is depicted as having a longitudinal length l. It will be understood that the array 100 may be energized (as described above with respect to FIGS. 2 and 3) to magnetize a predetermined length of the installed casing string (e.g., also having a length l). A longer section of the casing string may be magnetized in intervals, for example, each interval having a length l. For example, the electromagnetic array 100 may be lowered to the bottom of the well (e.g., at the lower end of a length of coiled tubing) or to some predetermined measured depth. A first section of casing string may then be magnetized via energizing the array 100 as described above. After de-energizing the array (disconnecting it from the electrical power source), the array 100 may then be moved to another longitudinal position (e.g., pulled towards the surface by a length l) and a second section of casing string magnetized. This iterative process may be utilized to quickly magnetize substantially any length of installed casing.

It will be understood that an iterative magnetization process (e.g., as described above) may advantageously enable distinct sections of the casing to be magnetized with correspondingly distinct magnetic field patterns. For example, a first section may be magnetized so as to have a relatively small spacing between pairs of magnetically opposing poles and a second section may be magnetized so as to have a larger spacing between pairs of magnetically opposing poles.

In preferred embodiments of the invention, the magnetization of an installed casing string imparts a substantially periodic pattern of opposing north-north (NN) magnetic poles and opposing south-south (SS) magnetic poles spaced apart along a longitudinal axis of the string. For example, the casing string may be magnetized to include a single pair of opposing magnetic poles per installed tubular (e.g., a single NN pole on a first tubular, a single SS pole on an adjacent tubular, and so on). In other preferred embodiments, the pole spacing may be more or less dense. The invention is not limited in these regards.

Imparting a substantially periodic pattern of opposing north-north (NN) magnetic poles and opposing south-south (SS) magnetic poles to a casing string as been found to provide a highly uniform magnetic field about the casing string (external to the string). This uniform magnetic field has further been found to be well suited for subsequent passive ranging, for example, in various well twinning and well intercept applications. Commonly assigned U.S. Pat. Nos. 7,617,049 and 7,656,161, each of which is fully incorporated by reference herein, disclose suitable passive ranging methodologies.

Figure 6:
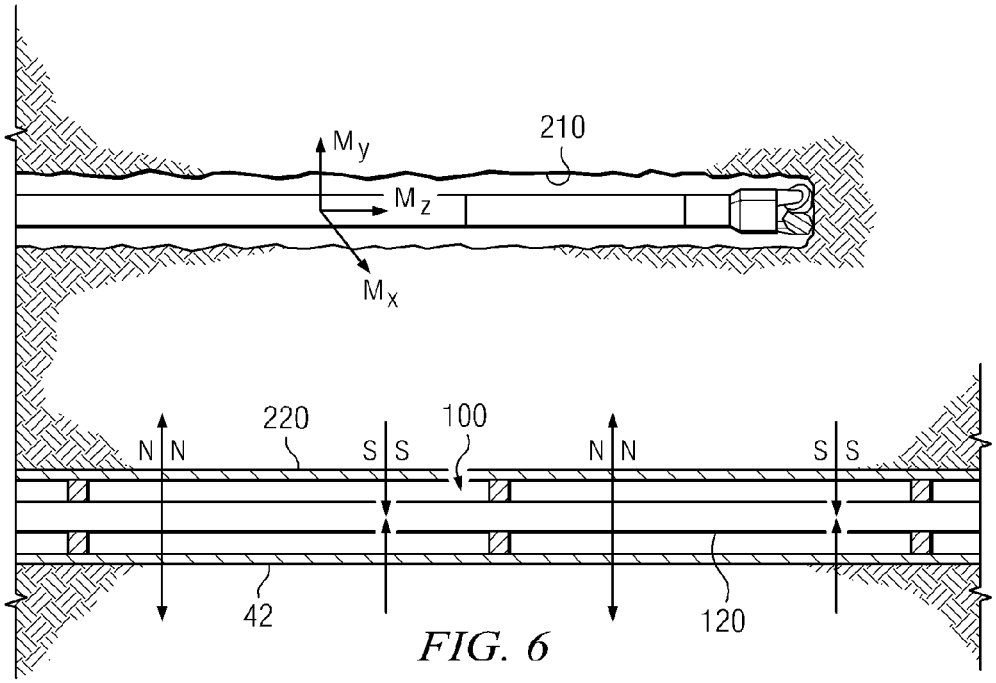
FIG. 6 depicts an active ranging operation using the electromagnetic array depicted on FIG. 1 as the active magnetic source.

FIG. 6 depicts an exemplary active ranging operation in which a twin well 210 (also referred to as a drilling well) is being drilled substantially parallel to a target well 220. In the exemplary embodiment depicted electromagnetic array 100 is deployed in the target well (either before or after casing the target well) and used as a magnetic source for the active ranging operation. As described above with respect to FIGS. 1 and 2, energizing the array 100 produces a plurality of pairs of magnetically opposing NN and SS magnetic poles along the length of the array which in turn results in the generation of a uniform magnetic field about the target well. The distance and/or direction between the twin 210 and target 220 wells may be determined using conventional magnetic ranging measurements, for example, those disclosed in U.S. Pat. Nos. 7,617,049 and 7,656,161.

During a well twinning operation (or another type of ranging operation), the twin well 210 may be drilled along the length of the array 100 (which is deployed in the target well 220 as depicted). After drilling some distance, the array 100 may be moved deeper into the target well 220. It's commonly advantageous to move the array 100 when a new length of drill pipe is added to the drill string (or interval lengths thereof, e.g., every second length of drill pipe or every third length of drill pipe, depending on the length of the array). The use of array 100 advantageously obviates the need to laterally align the magnetic source and the detectors in the drill string.

Figure 7:
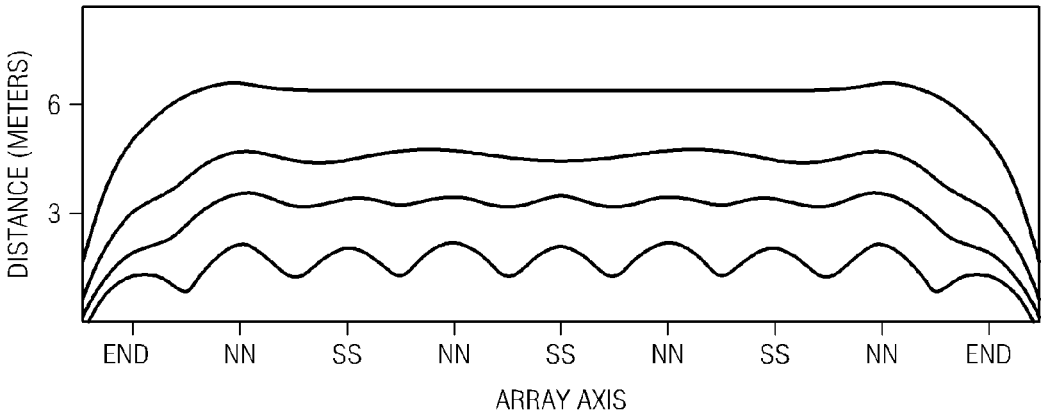
FIG. 7 depicts a contour plot of the theoretical magnetic flux density about a cased borehole having the electromagnetic array shown on FIG. 4 deployed therein and energized.

The magnetic field about a cased borehole in which an electromagnetic array is deployed and energized may be modeled, for example, using conventional finite element techniques. FIG. 7 shows a contour plot of the flux density about a cased borehole having an electromagnetic array similar to that depicted on FIG. 4 deployed therein and energized. Each electromagnet in the modeled array is 12 feet in length and includes 16,000 wraps about a two-inch diameter silicon iron (SiFe) core. The electromagnets are energized with a DC current of 1 amp. It will be appreciated that the invention is in no way limited by these exemplary model assumptions.

As shown on FIG. 7, the magnetic field strength (flux density) is advantageously highly uniform about the casing string, with the contour lines essentially paralleling the casing string at radial distances greater than about three meters. It will be understood that the terms magnetic flux density and magnetic field are used interchangeably herein with the understanding that they are substantially proportional to one another and that the measurement of either may be converted to the other by known mathematical calculations.

A mathematical model, such as that described above with respect to FIG. 7, may be utilized to create a map of the magnetic field about the target well in the vicinity of the electromagnetic array. During twinning of the target well, magnetic field measurements (e.g., the x, y, and z components measured by a tri-axial magnetometer) may be input into the model (e.g., into a look up table or an empirical algorithm based on the model) to determine the distance and direction to the target well. Various ranging methodologies are described in more detail in U.S. Pat. Nos. 7,617,049 and 7,656,161.

In active ranging embodiments it may be advantageous to vary or change the magnetic pattern generated by the electromagnetic array during drilling. For example, as described in more detail in the example given below, the pattern may be changed from one having seven pairs of magnetically opposing poles to one having three pairs of magnetically opposing poles. Changing the magnetic pattern can be readily accomplished, for example, by separately wiring each electromagnet in the array and changing the polarity (current direction) to various electromagnets as required. While such an arrangement is feasible, it would require running multi-core cabling from the surface to the electromagnetic array. Such multi-core cabling tends to be considerably thicker and more expensive than mono-core cabling.

Figures 8A, 8B, 8C:
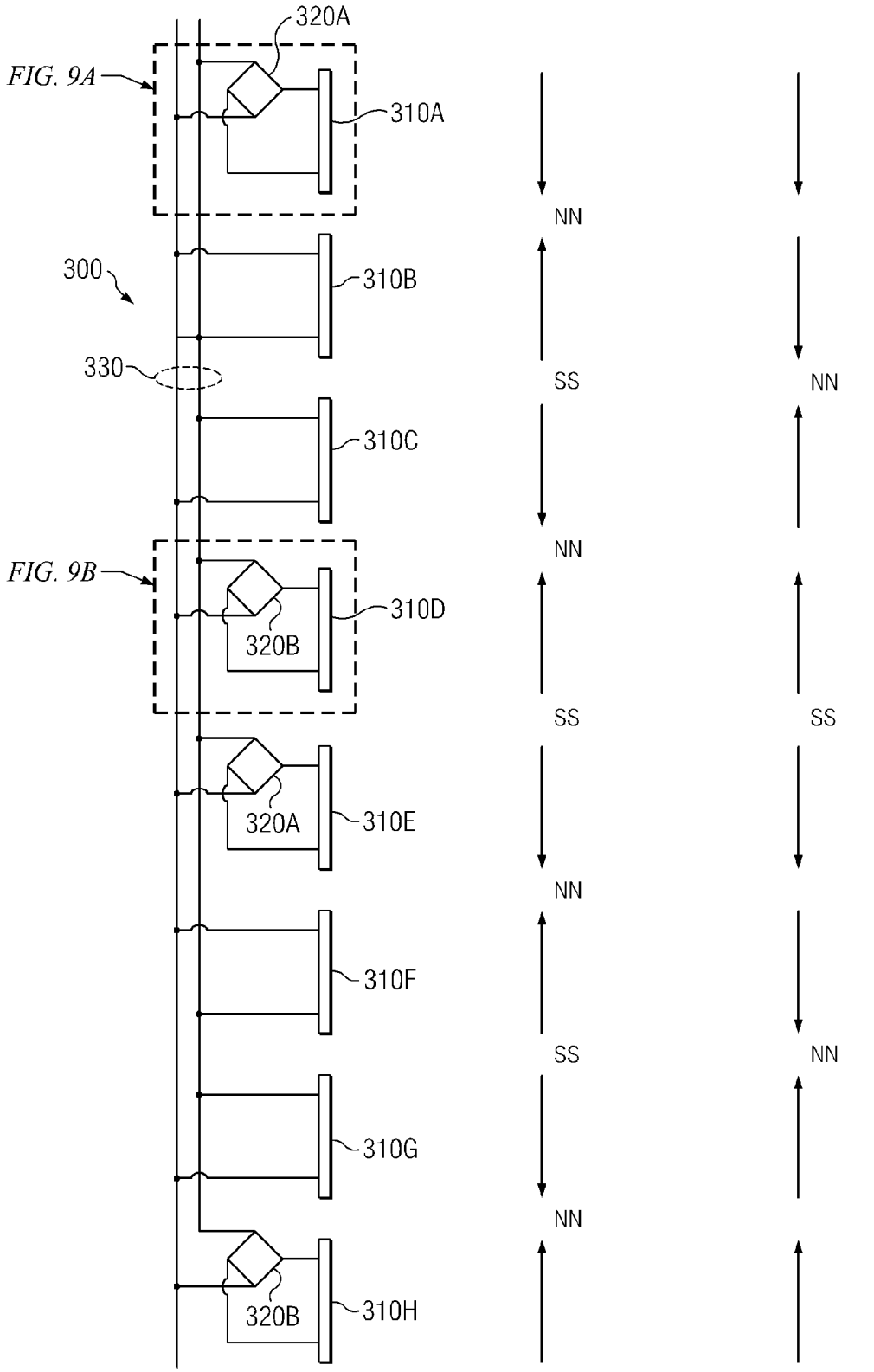
FIG. 8A depicts still another alternative electromagnetic array.
FIGS. 8B and 8C depict the magnetic polarities of electromagnets 310A-H in FIG. 8A for a positive applied electric current (FIG. 8B) and a negative applied electric current (FIG. 8C).

FIG. 8A depicts one exemplary arrangement of an electromagnetic array 300 configured to be used with mono-core cabling. The depicted array 300 is similar to array 100 (FIG. 2) in that it includes eight longitudinally spaced electromagnets 310A-H (referred to collectively as electromagnets 310). In the exemplary embodiment depicted, electromagnets 310A and 310E are connected to electrical power through corresponding diode bridges 320A while electromagnets 310D and 310H are connected to electrical power through corresponding diode bridges 320B.

Figure 9A:
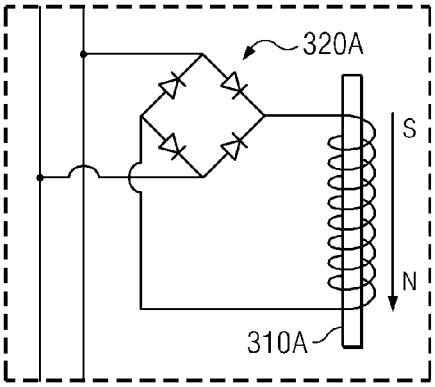
FIGS. 9A and 9B depict electromagnets 310A and 310D shown on FIG. 8A.
Figure 9B:
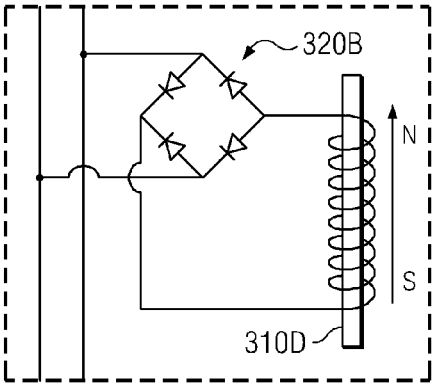

Diode bridges 320A and 320B are depicted in more detail in FIGS. 9A and 9B. As known to those of ordinary skill in the electrical arts, a diode bridge is an arrangement of diodes in a configuration that causes the polarity of the output to be independent of the polarity of the input. In the exemplary embodiment depicted diode bridges 320A are configured such that electromagnets 310A and 310E generate a magnetic field in a first direction (e.g., downward as depicted on FIGS. 8B and 8C) irrespective of the source polarity. Diode bridges 320B are configured such that electromagnets 310D and 310H generate a magnetic field in an opposing second direction (e.g., upward as depicted on FIGS. 8B and 8C) irrespective of the source polarity.

With reference again to FIG. 8A, electromagnets 310B, 310C, 310F, and 310G are connected directly to electrical power as depicted such that electromagnets 310B and 310C are polarized in opposing directions and electromagnets 310F and 310G are polarized in opposing directions. When electrical power having a first polarity is applied to the array 300, a magnetic field pattern having seven pairs of magnetically opposing poles (four NN and three SS poles) is generated as depicted on FIG. 8B. When the polarity of the applied electrical power is reversed, the magnetic field generated by electromagnets 310B, 310C, 310F, and 310G likewise reverses resulting in a magnetic field pattern having three pairs of magnetically opposing poles (two NN and one SS) as depicted on FIG. 8C. The configuration depicted on FIG. 8A may advantageously be powered using a single mono-core cable 330.

Those of ordinary skill in the art will appreciate that the electromagnets in FIG. 8A are depicted as being connected in parallel. They may also be connected in series. Such a series connection may be advantageous in certain applications in that it would ensure that the product of the electrical current and the number of turns (wraps) in the electromagnet is identical for each electromagnet. The depicted bridge diodes may also be employed on individual electromagnets, as desired, with series-interconnected electromagnet/diode assemblies.

Figure 10:
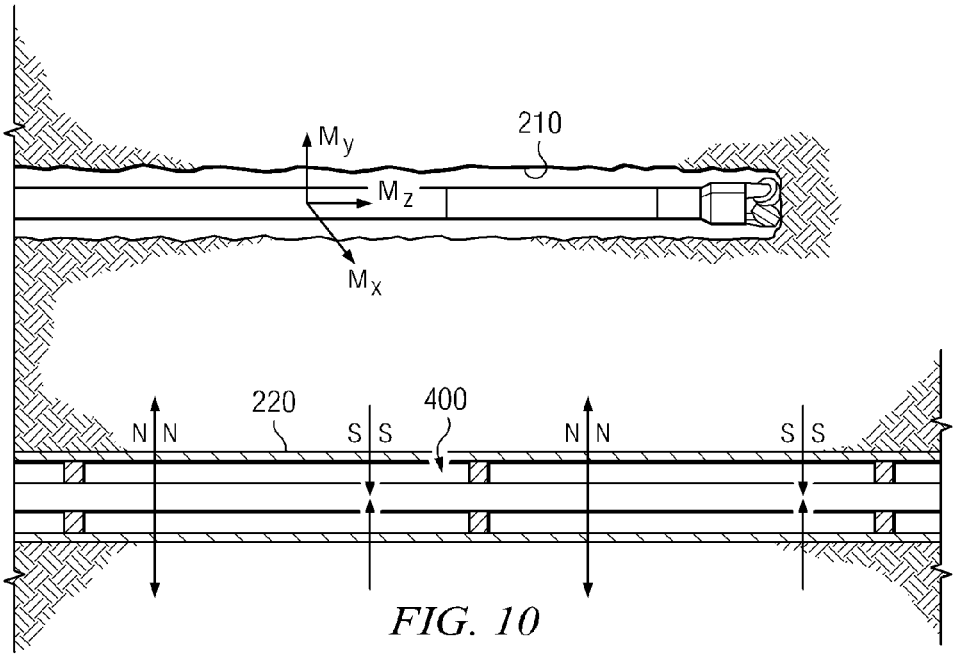
FIG. 10 depicts an active ranging operation using an array of permanent magnets as the active magnetic source.

FIG. 10 depicts an alternative ranging operation in which a twin well 210 is being drilled substantially parallel to a target well 220. In the exemplary embodiment depicted, a magnetic array 400 is deployed in the target well (either before or after casing the target well) and used as a magnetic source for the ranging operation. Magnetic array 400 (FIG. 11) is similar to electromagnetic array 100 in that it is configured to produce a plurality of pairs of magnetically opposing NN and SS magnetic poles along the length of the array which in turn results in the generation of a uniform magnetic field about the target well. Magnetic array 400 differs from electromagnetic array 100 in that it includes a plurality of permanent magnets 410A and 410B deployed in a non magnetic housing 120 (the housing 120 preferably including one or more centralizers 130 as also described above). The permanent magnets 410A and 410B are axially spaced apart from one another and deployed substantially coaxially with one another in the housing 120.

Permanent magnets 410A and 410B may be fabricated from substantially any suitable magnetic material; however, rare earth magnets are preferred due in part to their high strength. Rare earth magnets are well known to be made from alloys of rare earth elements and are generally considered to be the strongest permanent magnets. Preferred rare earth magnets include neodymium magnets and samarium-cobalt magnets. Neodymium magnets are generally considered to be the strongest rare earth magnets and are most preferred for low temperature applications (e.g., less than about 200 degrees C.). Samarium-cobalt magnets are generally considered to be the second strongest rare earth magnets and are known to have high Curie temperatures. Samarium-cobalt magnets are thus most preferred in high temperature applications (e.g., greater than about 200 degrees C.).

An advantageous permanent magnetic array typically includes at least eight magnets and is configured to induce at least four pairs of magnetically opposing poles, although the invention is not limited in this regard. In general, embodiments having a large number of regularly spaced permanent magnets (e.g., 8 or more) tend to be advantageous in that they produce a strong magnetic field, which in turn tends to provide a stronger, more uniform magnetic field about the casing string and thus enables more accurate and reliable ranging measurements. It will of course be appreciated that the advantages inherent in increasing the number of electromagnets should be balanced by the increased cost of such embodiments.

Figure 12:
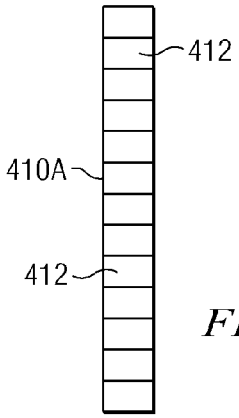
FIG. 12 depicts one exemplary embodiment of a permanent magnet shown on FIG. 11.

Each permanent magnet 410A and 410B may advantageously include a stack of smaller magnetic disks 412 as depicted on FIG. 12. The disks are typically (although not necessarily) on the order of two to four inches in diameter and one to two inches thick. A permanent magnet commonly includes 10 or more disks, although the invention is not limited in this regard.

It will be appreciated that the active ranging methodologies depicted on FIGS. 6 and 10 tend to impart certain advantages over the above described active ranging techniques (e.g., those disclosed in U.S. Pat. Nos. 5,485,089 and 5,589,775). For example, the use of an electromagnetic or a permanent magnet array providing a plurality of pairs of magnetically opposing poles obviates the need for precise lateral alignment of the magnetic source in the target well and the measurement sensors in the drilling well. This in turn tends to improve accuracy and increase the speed of the ranging operation.

Although the present invention and its advantages have been described in detail, it should be understood that various changes, substitutions and alternations can be made herein without departing from the spirit and scope of the invention as defined by the appended claims.

We claim:

1. An electromagnetic array configured for use in a subterranean borehole, the array comprising:

a substantially cylindrical non-magnetic housing configured to be deployed in a subterranean borehole;

at least first, second, third, and fourth, electromagnets deployed in the housing, the electromagnets being axially spaced apart and substantially co-axial with one another;

a first subset of the electromagnets configured to generate magnetic flux in a first axial direction when connected with an electrical power source and a second subset of the electromagnets configured to generate magnetic flux in a second opposing axial direction when connected with the electrical power source such that a magnetic field pattern having at least first and second pairs of magnetically opposing poles is generated; and each of the first and second subsets includes at least two of the electromagnets;

wherein at least the first electromagnets is electrically connected with a diode bridge which is configured to be connected with the electrical power source, the diode bridge being configured to provide an electrical current having a fixed polarity to the first electromagnet, irrespective of a polarity of the electrical power source;

wherein at least the second electromagnet is configured to be connected directly with the electrical current source such that a polarity of electrical current provided to the second electromagnet is identical to a polarity of the electrical power source; and wherein the magnetic field pattern generated by the electromagnetic array (i) has a first non-zero number of the magnetically opposing poles when the electrical power source has a first polarity and (ii) has a second different non-zero number of the magnetically opposing poles when the electrical power source has a second opposite polarity, and wherein the magnetically opposing poles have the same magnetic polarity.

2. The electromagnetic array of claim 1, wherein the non-magnetic housing comprises at least one centralizer configured to center the housing in a subterranean borehole.

3. The electromagnetic array of claim 1, wherein the third electromagnet is electrically connected with a second diode bridge, the second diode bridge being configured to provide electrical current having a fixed polarity the same as the second polarity to the third electromagnet.

4. The electromagnetic array of claim 1, wherein each of the electromagnets includes a magnetically permeable core having a length in a range from about 4 to about 16 feet, the cores being wound with about 4000 to about 16000 wraps of electrical conductor.

5. The electromagnetic array of claim 1, wherein the at least first, second, third, and fourth electromagnets are electrically connected in series.

6. The electromagnetic array of claim 1, wherein the at least first, second, third, and fourth electromagnets are electrically connected in parallel.

7. The electromagnetic array of claim 1, wherein the at least first, second, third, and fourth electromagnets are regularly spaced apart.

8. The electromagnetic array of claim 1, further comprising a mono-core cable configured to provide electrical power to each of the at least first, second, third, and fourth electromagnets.

9. A method for surveying a borehole with respect to a target well; the method comprising:

(a) deploying an electromagnetic array in the target well, the electromagnetic array including at least first, second, third, and fourth electromagnets deployed co-axially in a non-magnetic housing, wherein at least the first electromagnet is electrically connected with a diode bridge, the diode bridge being configured to provide an electrical current having a fixed polarity to the first electromagnet irrespective of a polarity of an electrical current source, the second electromagnet electrically connected to the electrical current source such that such that a polarity of electrical current provided to the second electromagnet is identical to a polarity of the electrical current source, wherein the electromagnetic array generates (i) a first magnetic field pattern having a first non-zero number of magnetically opposing poles when connected to the electrical current source having a first polarity and (ii) a second magnetic field pattern having a second different non-zero number of magnetically opposing poles when connected to the electrical current source having a second opposite polarity, the magnetically opposing poles having the same magnetic polarity;

(b) connecting the at least first, second, third, and fourth electromagnets in the electromagnetic array to the electrical current source having the first polarity so as to generate a magnetic field having the first magnetic field pattern;

(c) positioning a downhole tool having a magnetic field measurement device in the borehole, the downhole tool positioned within sensory range of the magnetic field having the first magnetic field pattern generated by the electromagnetic array;

(d) measuring a local magnetic field in the borehole using the magnetic field measurement device; and (e) processing the local magnetic field measured in (d) to determine at least one of (i) a distance and (ii) a direction from the borehole to the target well.

10. The method of claim 9, further comprising:

(f) processing at least one of the (i) distance and (ii) direction determined in (e) to determine a subsequent direction for drilling the borehole.

11. The method of claim 9, further comprising:

(f) connecting the at least first, second, third, and fourth electromagnets in the electromagnetic array to the electrical current source having the second polarity so as to generate a magnetic field having the second magnetic field pattern;

(g) repeating (d) and (e).

* * * * *